United States Patent [19]

Hardt et al.

[11] Patent Number: 4,975,591

[45] Date of Patent: Dec. 4, 1990

[54] DOCKING ARRANGEMENT FOR CONTAINERS RECEIVING RADIOACTIVE MATERIALS

[75] Inventors: Norbert Hardt; Haken Sterner, both of Hanover; Michael Nöth, Seelze; Burkart Schulte, Minden, all of Fed. Rep. of Germany

[73] Assignee: Deutsche Gesellschaft für Wiederaufarbeitung von Kernbrennstroffen mbH, Hanover, Fed. Rep. of Germany

[21] Appl. No.: 482,460

[22] Filed: Feb. 21, 1990

[30] Foreign Application Priority Data

Feb. 22, 1989 [DE] Fed. Rep. of Germany ..... 3905362

[51] Int. Cl.[5] ..... G21F 5/00

[52] U.S. Cl. ..... 250/506.100; 250/507.100; 250/505.100; 252/633

[58] Field of Search ..... 250/506.1, 507.1, 505.1; 252/633

[56] References Cited

U.S. PATENT DOCUMENTS

| | | | |
|---|---|---|---|
| 4,456,827 | 6/1984 | Botzem et al. | 250/506.1 |
| 4,528,454 | 7/1985 | Baatz et al. | 250/506.1 |
| 4,818,878 | 4/1989 | Popp et al. | 250/506.1 |
| 4,847,009 | 7/1989 | Madle et al. | 250/506.1 |
| 4,874,573 | 10/1989 | Wood et al. | 250/506.1 |
| 4,893,022 | 1/1990 | Hall et al. | 250/506.1 |

*Primary Examiner*—Jack I. Berman

*Assistant Examiner*—Kiet T. Nguyen

*Attorney, Agent, or Firm*—Walter Ottesen

[57] ABSTRACT

The invention is directed to a docking arrangement for docking a container to a lock having a first side facing into a first chamber wherein contamination is present and a second side facing into a second chamber free of contamination. A lock wall defines the lock opening and a lock cover is adapted to close the lock opening. The container is provided for receiving radioactive materials and has a container vessel which is closed by a container cover. The docking arrangement includes an intermediate cover releasably connectable to the container cover. A holder is provided for engaging the intermediate cover to move the intermediate cover together with the container cover for opening and closing the lock opening. The intermediate cover is disposed between the lock cover and the container cover. An annular member is located on the second side and form-fittingly engages the lock wall. The intermediate cover is subdivided into a first portion covering the container cover and a second portion covering the annular member with the second portion extending to the lock wall. A first set of seals seals the docking arrangement with respect to parts which should not be subjected to contamination. Another set of seals seals the cover with respect to the annular member. The docking arrangment makes possible a rapid and simple exchange for other docking arrangements for containers and their covers having different dimensions without any problems occurring with reference to contamination.

3 Claims, 2 Drawing Sheets

DOCKING ARRANGEMENT FOR CONTAINERS RECEIVING RADIOACTIVE MATERIALS

BACKGROUND OF THE INVENTION

A side of a lock faces into a contamination-free chamber and the invention relates to an arrangement for docking containers, which receive radioactive materials, to this side of the lock in a form-tight manner. The invention is applied to a lock which is known in practice and includes a lock cover which can be opened and closed together with the container cover by means of a holder which extends through the lock cover.

SUMMARY OF THE INVENTION

It is an object of the invention to provide a docking arrangement which is easily accessible and which can be quickly and easily exchanged for another arrangement for containers and their covers having other dimensions and which includes regions which must necessarily be kept free for protection against contamination.

The docking arrangement of the invention is for docking a container to a lock having a first side facing into a first chamber wherein contamination is present and a second side facing into a chamber free of contamination, the container being provided for receiving radioactive materials and having a container vessel which is closed by a container cover having a peripheral edge section. The docking arrangement includes: a lock wall defining a lock opening; a lock cover adapted to close the lock opening; an intermediate cover disposed between the lock cover and the container cover and having a first portion covering the container cover; releasable connecting means for releasably connecting the container cover to the intermediate cover at the first portion thereof; a holder extending through the lock cover for engaging the intermediate cover to move the intermediate cover together with the container cover for opening and closing the lock opening; the first portion having a first section adjacent the peripheral edge section of the container cover; a first seal disposed between the sections for permitting the first portion to engage the container cover via the seal; an annular member located on the second side so as to define an interface with the lock wall; engaging means at the interface for providing a form-fitting positive engagement of the annular member with the lock wall; releasable attaching means for releasably attaching the intermediate cover to the annular member; the intermediate cover having a second portion outwardly of the first portion to cover the annular member and to extend up to the lock wall; the second portion having a second section adjacent the lock wall; a second seal disposed between the second section and the lock cover for permitting the second portion of the intermediate cover to engage the lock cover via the second seal; the first portion and the second portion of the intermediate cover having a transition section therebetween at the region of the peripheral edge of the container cover; a third seal interposed between the transition section and the annular member for permitting the intermediate cover to engage the annular member via the third seal; the annular member having a section disposed adjacent the container vessel; a fourth seal interposed between the section of the annular member and the container vessel for permitting the annular member to engage the container vessel via the seal; the second section of the intermediate cover and the lock wall conjointly defining a peripheral interface therebetween; and, a fifth seal located at the region of the peripheral interface so as to be interposed between the annular member and the intermediate cover as well as between the annular member and the lock wall for permitting the annular member to engage both the intermediate cover and the lock wall via the fifth seal.

The docking arrangement according to the invention makes possible a rapid and simple exchange for other docking arrangements adapted to containers and their covers having different dimensions and this exchange is performed without any problems with reference to contamination. In this way, the outer surfaces of the closed docking arrangement are protected against contamination. The outer surfaces of the closed containers are also protected against contamination. The invention further assures that there is an absolute sealing integrity between the container and the docking wall in the docked condition.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
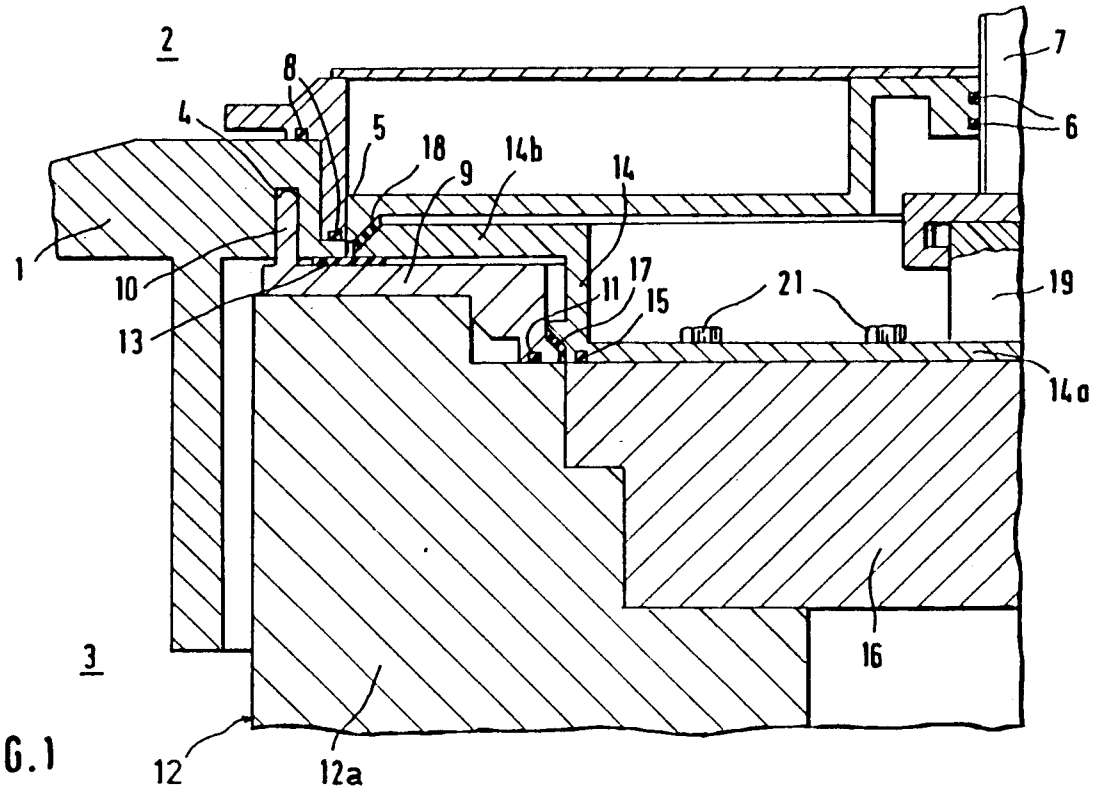
FIG. 1 is a partial section view of a docking arrangement according to the invention with the docking arrangement being mounted on a container docked at a lock; and, FIG. 2 is a schematic, partially in section, showing details of the docking arrangement of the invention in the undocked condition and disconnected from the container.

Reference numeral 1 identifies a lock wall which is configured as a receiving ring and is floatingly journalled in a partition wall (not shown) between a contaminated chamber 2 and a contamination-free chamber 3. The lock wall 1 is floatingly journalled in a plane which extends radially to the lock-opening axis. The lock wall 1 is provided with an annular slot 4 facing into the contamination-free chamber 3.

The lock wall 1 supports a lock cover 5 at its side facing into chamber 2. The cover 5 is displaceable by means of a holder 7 which extends through this cover and is sealed via seals 6. In the closed condition of the lock, the lock cover 5 is sealed with respect to the lock wall 1 by seals 8. The annular slot 4 receives and centers the annular member 9 which engages the annular slot 4 with a collar 10. The annular member 9 has a seal 11 attached thereto and a seal 13 also attached thereto. The annular member 9 is sealed with respect to the container vessel 12*a* of the container 12 by the seal 11 and with respect to the lock wall 1 by seal 13. The seal 13 also seals the annular member 9 with respect to the intermediate cover 14.

The intermediate cover 14 has a seal 15 attached thereto and is sealed with respect to the cover 16 of the container 12 by the seal 15. The intermediate cover 14 is sealed with respect to the annular member 9 by a seal 17 and with respect to lock cover 5 by means of a seal 18 attached to the lock cover 5. The seals 17 and 18 are mounted so as to be inclined to the axis of the container 12. The intermediate cover 14 includes a T-shaped head 19 for facilitating engagement by the holder 7.

Figure 2:
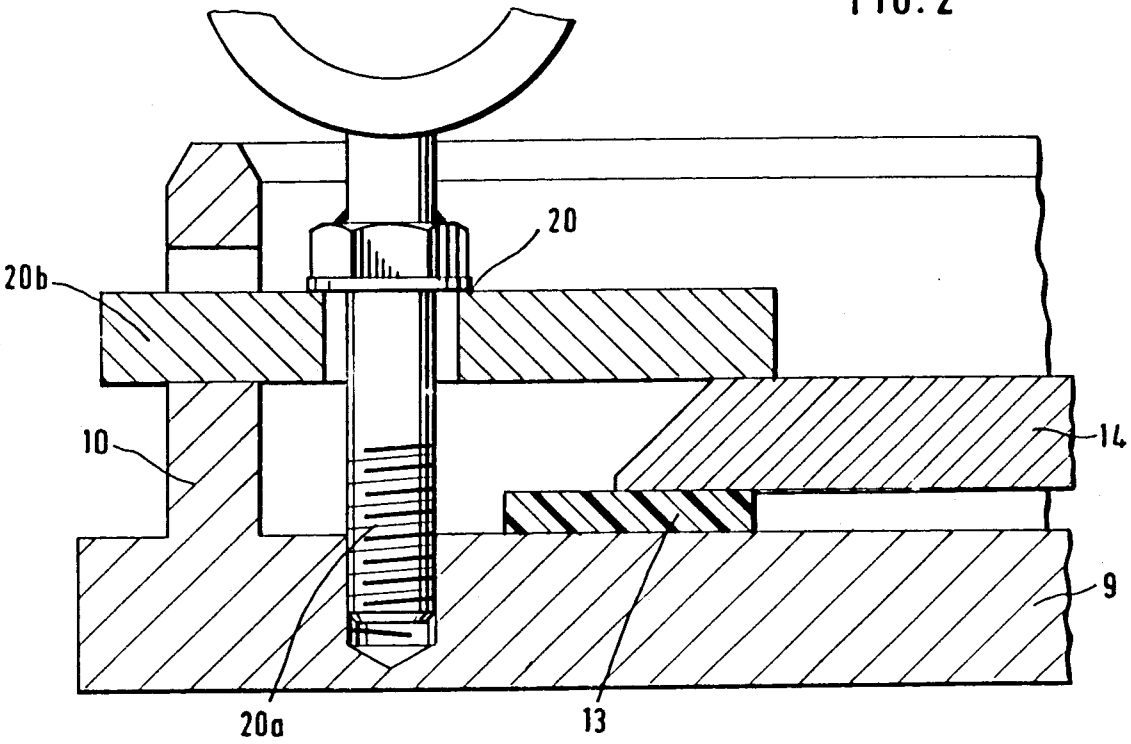

For the condition wherein the docking arrangement is in the undocked condition, the intermediate cover 14 is connected to the annular member 9 by means of releasable attaching means 20 (see FIG. 2). The attaching means 20 includes a plurality of attaching units distributed uniformly about the periphery of the docking arrangement and each attaching unit includes a threaded bolt 20*a* and a clamping plate 20*b*.

For the condition of the docking arrangement mounted to the container 12, the annular member 9 covers the container vessel 12*a* while the intermediate cover 14 covers the container cover 16 with a first portion 14*a*. The cover 14 is provided with releasable connecting means which can be in the form of a plurality of threaded fasteners 21 at the first portion 14*a*. The intermediate cover 14 also has a second portion 14*b* which extends over the annular member 9 and up to the lock wall 1.

The operation of the docking arrangement according to the invention is described below.

For each type of container, a docking arrangement is required which is different in its dimensions because of the different geometries of the container types which can, for example, include a transport container, a transport and storage container or a terminal storage container.

The docking arrangement corresponding to the particular container type is held together by the attaching means 20. The docking arrangement is seated on the container 12 before docking the container 12 to the lock wall 1. In this way, the annular member 9 self centers on a predetermined surface of the container 12. After the intermediate cover 14 is attached to the container cover 16 with the threaded fasteners 21, the attaching units 20 are removed and the container 12 together with the docking arrangement is brought to the lock. When docking, the annular member 9 self centers in the annular slot 4 with its collar 10.

In order to fill the container 12, the T-shaped head 19 is first engaged by a rotational movement of the holder 7. The holder 7 is then pulled upwardly and therewith also the intermediate cover 14, the container cover 16 and the lock cover 5 whereby the lock as well as the container 12 are opened. In this condition, the seals (11, 13, 17 and 18) prevent a contamination of all outer surfaces exposed when the docking arrangement is closed and when the container is closed. There is no negative effect of a contamination between the two parts 9 and 14 of the docking arrangement because this intermediate space is hermetically sealed by the parts 9 and 14, which are moved toward each other, as well as by the two seals 13 and 17 when closing the lock and simultaneously closing the container.

It is understood that the foregoing description is that of the preferred embodiments of the invention and that various changes and modifications may be made thereto without departing from the spirit and scope of the invention as defined in the appended claims.

What is claimed is:

1. A docking arrangement for docking a container to a lock having a first side facing into a first chamber wherein contamination is present and a second side facing into a chamber free of contamination, the container being provided for receiving radioactive materials and having a container vessel which is closed by a container cover having a peripheral edge section, the docking arrangement comprising:

a lock wall defining a lock opening;

a lock cover adapted to close said lock opening;

an intermediate cover disposed between said lock cover and the container cover and having a first portion covering the container cover;

releasable connecting means for releasably connecting said container cover to said intermediate cover at said first portion thereof;

a holder extending through said lock cover for engaging said intermediate cover to move said intermediate cover together with the container cover for opening and closing said lock opening;

said first portion having a first section adjacent the peripheral edge section of the container cover;

a first seal disposed between said sections for permitting said first portion to engage said container cover via said seal;

an annular member located on said second side so as to define an interface with said lock wall;

engaging means at said interface for providing a form-fitting positive engagement of said annular member with said lock wall;

releasable attaching means for releasably attaching said intermediate cover to said annular member;

said intermediate cover having a second portion outwardly of said first portion to cover said annular member and to extend up to said lock wall;

said second portion having a second section adjacent said lock wall;

a second seal disposed between said second section and said lock cover for permitting said second portion of said intermediate cover to engage said lock cover via said second seal;

said first portion and said second portion of said intermediate cover having a transition section therebetween at the region of the peripheral edge of the container cover;

a third seal interposed between said transition section and said annular member for permitting said intermediate cover to engage said annular member via said third seal;

said annular member having a section disposed adjacent the container vessel;

a fourth seal interposed between said section of said annular member and the container vessel for permitting said annular member to engage said container vessel via said seal;

said second section of said intermediate cover and said lock wall conjointly defining a peripheral interface therebetween; and, a fifth seal located at the region of said peripheral interface so as to be interposed between said annular member and said intermediate cover as well as between said annular member and said lock wall for permitting said annular member to engage both said intermediate cover and said lock wall via said fifth seal.

2. The docking arrangement of claim 1, the container defining a longitudinal axis and said second and third seals being mounted so as to be inclined with respect to said axis.

3. The docking arrangement of claim 2, said second seal being attached to said lock cover.

* * * * *